United States Patent [19]

Iwans et al.

[11] 4,137,580

[45] Feb. 6, 1979

[54] TOILET

[75] Inventors: Robert C. Iwans, Farmington; Richard C. Lamb, Plantsville, both of Conn.

[73] Assignee: Koehler-Dayton, Inc., New Britain, Conn.

[21] Appl. No.: 816,584

[22] Filed: Jul. 18, 1977

[51] Int. Cl.[2] ..... E03D 11/02

[52] U.S. Cl. ..... 4/420; 4/181; 4/187 A

[58] Field of Search ..... 4/89, 10, 78, 114, 420, 4/187 A, 181; 220/315, 324, 338, 340

[56] References Cited

U.S. PATENT DOCUMENTS

| | | | |
|---|---|---|---|
| 533,062 | 1/1895 | Hoelscher | 4/89 |
| 1,101,587 | 6/1914 | Trinder | 220/324 |
| 1,484,288 | 2/1924 | Benedict | 220/324 |
| 2,642,987 | 6/1953 | Castelli | 220/340 |
| 3,411,162 | 11/1968 | Palmer | 4/89 |
| 3,538,518 | 11/1970 | Helke et al. | 4/10 |
| 3,602,262 | 8/1971 | Hinden | 138/39 |

*Primary Examiner*—Richard E. Aegerter
*Assistant Examiner*—L. Footland
*Attorney, Agent, or Firm*—Spencer T. Smith

[57] ABSTRACT

A toilet including, a bowl having at the top thereof a substantially horizontal annular flange which merges into a substantially vertically extending annular lip portion, a pin secured to the bowl, an opening defined in the lip portion at a location remote from the pin, a flush ring having an annular flange for seating on the bowl flange portion, the flush ring including an outwardly projecting tab portion selectively configured for insertion into the opening, and latch means pivotally secured to the flush ring for selective locking engagement with the pin.

5 Claims, 3 Drawing Figures

TOILET

The present invention relates to toilets and particularly to recirculating toilets which are conventionally used on vehicles such as buses, trains, planes, recreational trailers, campers or the like.

The flushing medium in such prior art toilets may be directed tangentially either in a clockwise or counter-clockwise direction into a flush ring or manifold. The flush ring may have a single continuous annular opening at the bottom thereof whereby flushing medium will flow downwardly through the opening establishing a tangential flushing pattern around the toilet bowl. Such a toilet is disclosed in detail in U.S. Pat. No. 3,538, 518.

Foreign materials such as paper, will occasionally become a part of the flushing medium. These materials tend to clog the flush ring opening deleteriously affecting the performance of the toilet. Cleaning this flush ring has proven to be a most difficult and long-standing problem with coat hangers often being utilized to clean this opening. As a result, these toilets seldom perform in a completely satisfactory manner.

It is, accordingly, an object of the present invention to provide such a toilet which can be maintained in a clean condition.

Among the advantages of the present invention is the reduction in service time required to properly maintain the cleanliness of the flush ring.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
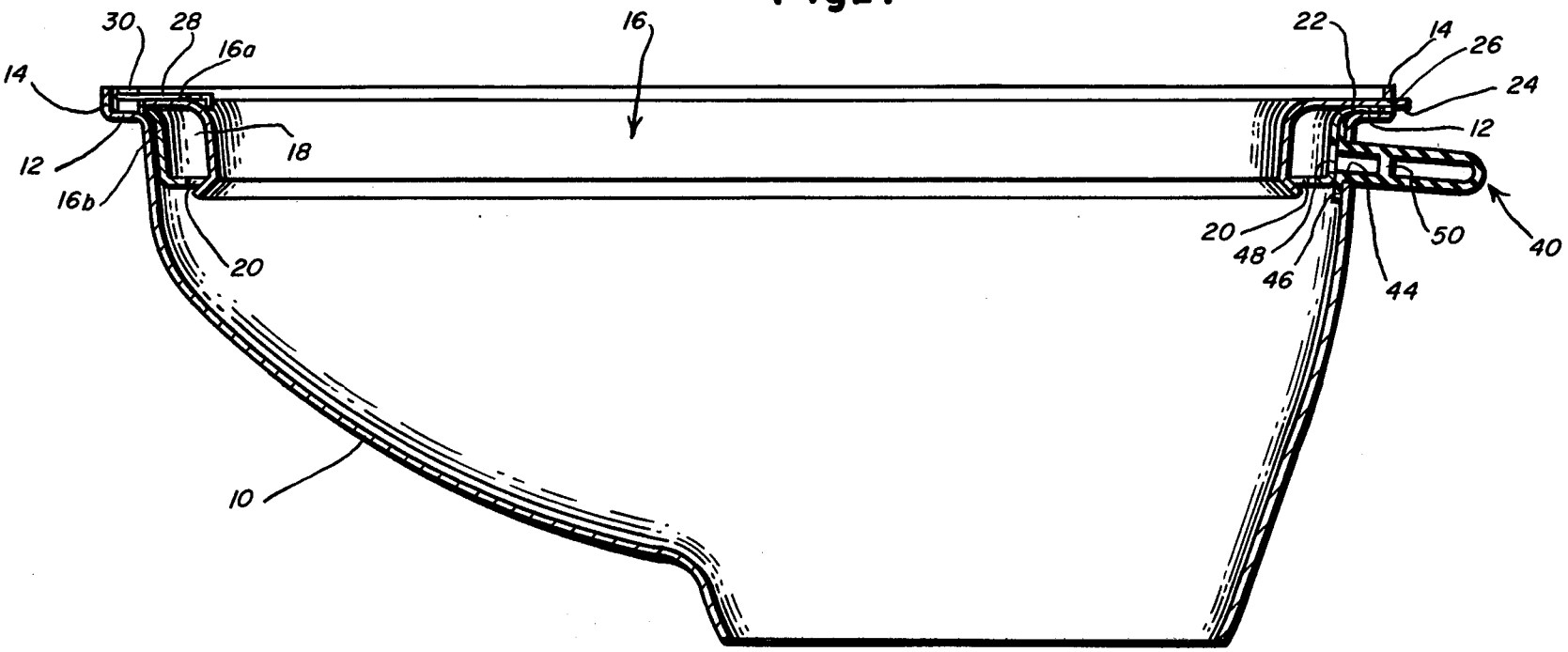
FIG. 1 is an elevational view of a toilet bowl structure made in accordance with the teachings of the present invention.
Figure 2:
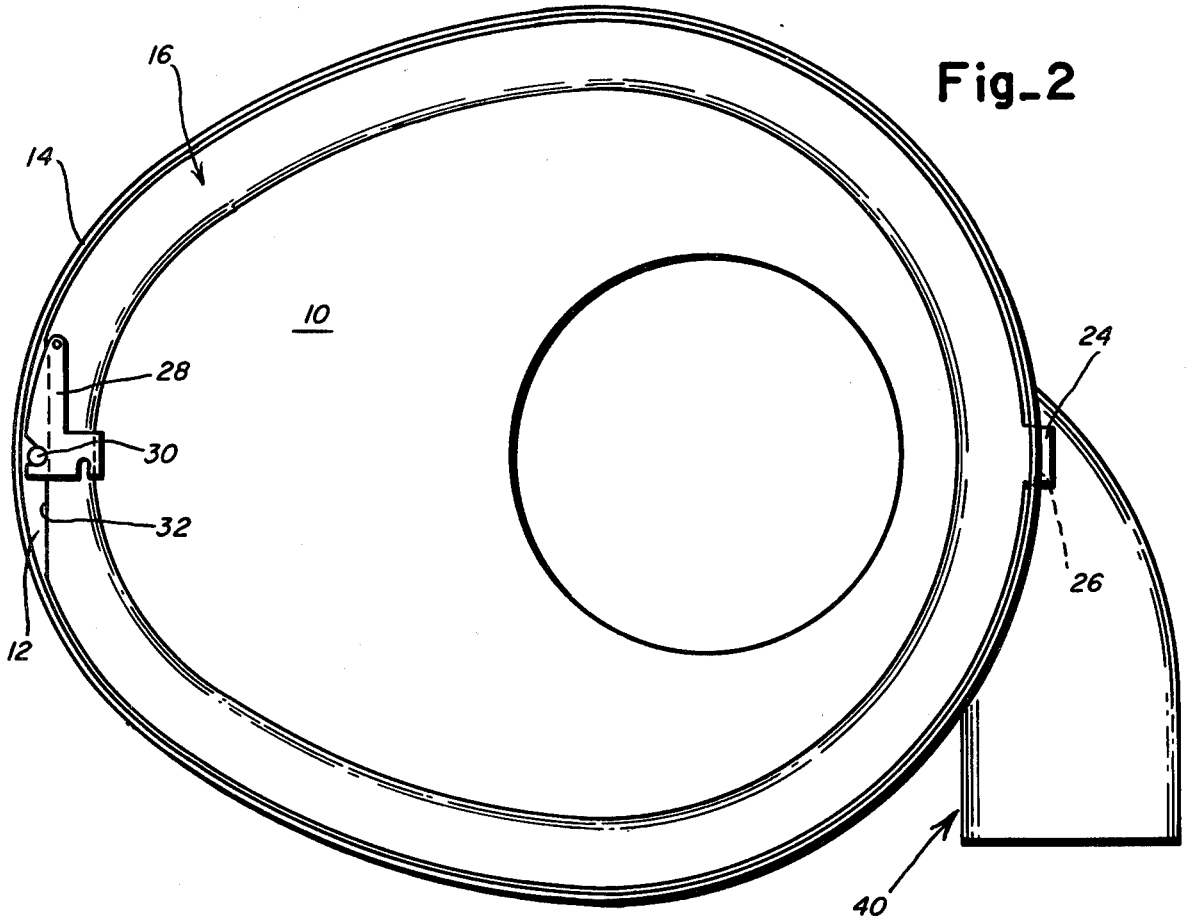
FIG. 2 is a top view of the toilet bowl structure illustrated in FIG. 1.

The toilet bowl structure includes a bowl 10 which has, at its top, a horizontal outwardly extending peripheral flange 12 which merges into an upwardly extending peripheral lip 14. A flush ring 16, which is formed by two annular pieces **16*a*, 16*b*, spot welded to each other, defines an annular channel 18 having a continuous opening 20. The flush ring 16 has a peripheral outwardly extending flange 22, which rests on the bowl flange 12. The flush ring flange has a rearwardly extending tab 24, which is slidingly inserted into a horizontal slot 26 defined in the lip of the bowl. Pivotally secured to the top surface of the flush ring flange 22 is a latch member 28 which selectively, latchingly, engages a vertically standing latch pin or rivet 30 which is secured to the upper surface of the bowl flange 12. The front end 32 of the flush ring flange 22 is cut off to preclude interference between the flush ring 16 and the rivet 30**.

The upwardly extending bowl lip 14 contains any flushing medium which escapes between the annular flush ring pieces **16*a*, 16*b*, permitting such flushing medium to flow back into the bowl 10**.

Figure 3:
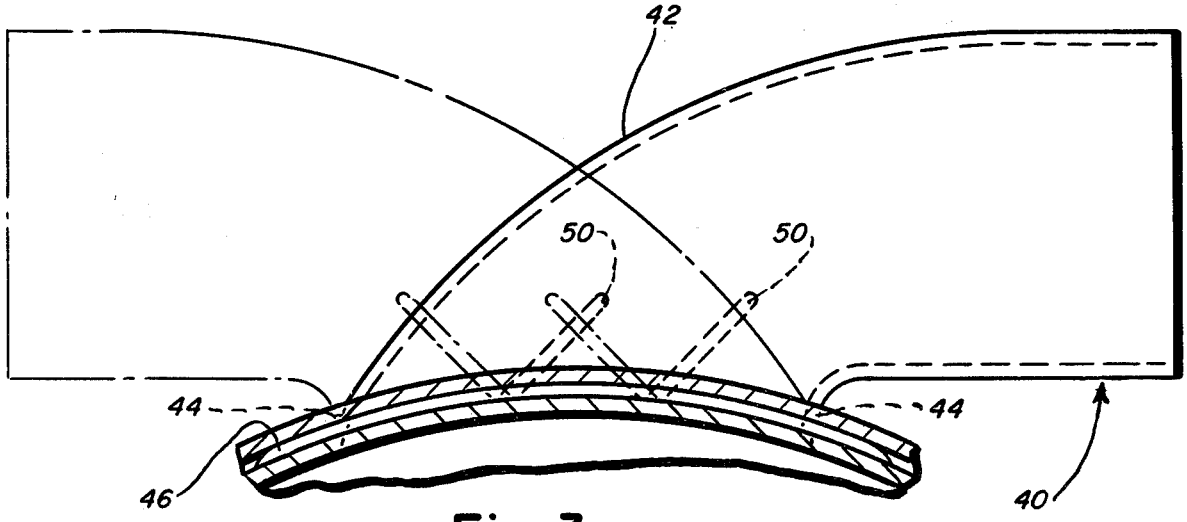
FIG. 3 is a top view partially broken away of a portion of the toilet bowl structure illustrated in FIG. 2.

As can be seen from FIGS. 1 and 3, flushing medium is directed to the flush ring through a muff 40 which has a channel portion 42 which passes through a suitably configured bowl slot 44. The muff has an annular flange 46 at one end which is compressively sandwiched between the flush ring 16 and the toilet bowl 10. Flushing medium is pumped under pressure through the muff 40, through a suitable configured opening 48 in the proximate side of the flush ring into the flush ring. Tangential flow is established in the muff 40 by a pair of oblique baffle members 50.

The toilet bowl structure has many desirable features. Tangential flow may be either clockwise or counter-clockwise depending only on the position of the muff. Part inventories are halved over conventional toilets wherein counter-clockwise flow and clockwise flow toilets were not interchangeable. Complete cleaning of the flush ring is now possible, since it can be completely and easily removed from the toilet bowl, replaced with a clean flush ring, and subsequently reused after a thorough cleaning.

What is claimed is:

1. A toilet including a bowl having at the top thereof a substantially horizontal annular flange portion which merges into a substantially vertically extending annular lip portion, a first flush ring portion having a substantially horizontal annular flange for resting on and establishing a non-water-tight seal with said bowl flange portion, a second flush ring portion having a substantially horizontal annular flange for resting on and establishing a non-water-tight seal with said first flush ring portion flange, said first and second flush ring portions defining a flush ring having an annular opening, and means for maintaining said first and second flush ring portions on said toilet bowl flange.

2. A toilet according to claim 1, wherein said maintaining means comprises pin means secured to said bowl, a slot defined in said lip portion at a location remote from said pin means, tab means outwardly projecting from said second flush ring flange selectively configured for insertion into said slot, and latch means pivotally secured to said second flush ring flange for selective locking engagement with said pin means.

3. A toilet according to claim 2 further comprising inlet muff means, said muff means including selectively inclined baffle means for directing flushing medium into said flush ring at a predetermined angle.

4. A toilet according to claim 2 wherein said pin means projects upwardly.

5. A toilet according to claim 4 wherein said seat is horizontal.

* * * * *